US006663523B1

(12) United States Patent
Chiuch

(10) Patent No.: US 6,663,523 B1
(45) Date of Patent: Dec. 16, 2003

(54) AUXILIARY CHAIN FOR DRAWING ASSEMBLY IN DRAWING MACHINES

(75) Inventor: Bruno Chiuch, S. Leonardo (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 10/069,149

(22) PCT Filed: May 18, 2000

(86) PCT No.: PCT/IB00/00666

§ 371 (c)(1),
(2), (4) Date: Feb. 22, 2002

(87) PCT Pub. No.: WO01/14075

PCT Pub. Date: Mar. 1, 2001

(30) Foreign Application Priority Data

Aug. 26, 1999 (IT) ..... UD99A0053

(51) Int. Cl.[7] ..... F16G 13/02; E21B 19/22

(52) U.S. Cl. ..... 474/226; 474/206; 166/77.3; 166/85.5

(58) Field of Search ..... 474/156, 219, 474/222, 223, 226, 229, 228, 901, 206, 209, 196, 902; 166/173, 172, 77.3, 85.5, 88.3, 382; 226/173, 100, 172; 305/59, 107; 59/78, 78.1

(56) References Cited

U.S. PATENT DOCUMENTS 1,259,716 A * 3/1918 Bens ..... 474/229
2,012,947 A * 9/1935 Bosnian ..... 474/219
2,893,788 A * 7/1959 Yerian ..... 474/222
3,285,485 A * 11/1966 Slator ..... 166/77.3
3,365,246 A 1/1968 William et al.
4,735,270 A * 4/1988 Fenyvesi ..... 166/77.3
5,188,174 A * 2/1993 Anderson, Jr. ..... 166/77.3
5,918,671 A * 7/1999 Bridges et al. ..... 166/77.3
5,975,203 A * 11/1999 Payne et al. ..... 166/77.3
6,120,405 A * 9/2000 Oertley et al. ..... 474/901
6,347,664 B1 * 2/2002 Perio, Jr. ..... 166/77.3

FOREIGN PATENT DOCUMENTS

| | | |
|---|---|---|
| DE | 19711101 | 4/1998 |
| EP | 0645200 | 3/1995 |
| FR | 1082651 | 12/1954 |

* cited by examiner

*Primary Examiner*—Marcus Charles
(74) *Attorney, Agent, or Firm*—Stevens, Davis, Miller & Mosher, LLP

(57) ABSTRACT

The present invention is an auxiliary chain for drawing assemblies including at least a track formed by multiple contiguous links able to act on a product to draw it. The auxiliary chain is interposed between the relative track and support the auxiliary chain including multiple contiguous links, each link including an idler roll equipped with an axial hole, a join pin and two connection elements each suitable to cooperate with a respective end of the idler roll.

8 Claims, 2 Drawing Sheets

AUXILIARY CHAIN FOR DRAWING ASSEMBLY IN DRAWING MACHINES

FIELD OF THE INVENTION

This invention concerns an auxiliary chain for drawing assemblies in drawing machines.

The drawing assemblies to which the chain according to the invention is applied are of the type comprising two opposite and counter-rotating tracks which collaborate with a product being processed to draw it through a die plate of a drawing machine.

The auxiliary chain according to the invention is suitable to be arranged inside a respective track to reduce the friction between the latter and relative rigid supporting means, and to distribute uniformly the forces of thrust which act thereon during the drawing steps.

During the operating cycles, very high loads-may affect the tracks according to the reduction in section to be imparted to the products being worked.

BACKGROUND OF THE INVENTION

The state of the art includes drawing assemblies used in drawing machines and consisting of two counter-rotating tracks opposite each other with respect to the drawing axis, each comprising a plurality of links on each of which respective pads are mounted, suitable to grip and draw the metal product being worked through a draw plate.

Motion is supplied to every track by a pair of toothed wheels, normally a drive wheel and a driven wheel, which are mounted at the ends of a rigid supporting plate around which the track itself is closed in a ring.

In the state of the art, between the supporting plate and the relative track, an auxiliary chain is provided, wound around the supporting plate, on which the links of the track rest at least in the rectilinear segment of the latter.

These auxiliary chains are used to reduce the friction between the tracks and the relative supporting plate, and to discharge uniformly the high forces of thrust which act on the individual links of the tracks, particularly during the operational drawing cycles.

In the state of the art, the auxiliary chain is made up of links, and every individual link consists of a containing cage inside which two or more idler rolls are housed.

Each link also comprises first pins suitable to associate the different containing cages together, creating the structural connection of the chain, and second pins suitable to associate the individual idler rolls to the relative containing cages.

The pins, and particularly the first pins suitable to associate the individual links of the auxiliary chain, are subjected to considerable mechanical stresses since a large proportion of the thrust forces of drawing and compression discharged onto the idler rolls by the tracks of the drawing assembly are in fact discharged onto said pins.

The pins of conventional auxiliary chains, therefore, are easily subject to breakages, and when these happen, the machine necessarily has to be stopped for a long time.

Another disadvantage of conventional auxiliary chains is that the cages containing the idler rolls are difficult to achieve and assemble, particularly due to the presence of at least three pins for every link.

Furthermore, conventional auxiliary chains are not very flexible because each link comprises at least two idler rolls and therefore do not adapt very well to the profile of the supporting plate, particularly in the curved segments of the latter.

The present Applicant has devised and embodied this invention to overcome the shortcomings of conventional auxiliary chains and to obtain further advantages as shown hereafter.

SUMMARY OF THE INVENTION

The main purpose of the invention is to achieve an auxiliary chain for drawing assemblies in drawing machines which will be easy to achieve and assemble, efficient, resistant, unlikely to break or malfunction and suitable to bear very high loads.

Another purpose of the invention is to achieve an auxiliary chain suitable to adapt in the best possible way to the curves defined by the profile of the rigid supporting plate on which it is wound.

Another purpose of the invention is to achieve an auxiliary chain consisting of a limited number of components and wherein the same pin is used both to support an idler roll and also to couple two adjacent links together.

Another purpose is to achieve an auxiliary chain wherein the forces of thrust acting on the idler rolls are discharged uniformly over the entire link, thus reducing the risks of breakages.

In accordance with these purposes, an auxiliary chain according to the invention consists of a plurality of links, each comprising an idler roll, a join pin and two connection elements arranged opposite each other respectively on one side and the other of the link, each of which is suitable to cooperate with a respective end of the idler roll.

Each connection element is suitable to be arranged at least partly superimposed with respect to at least two adjacent idler rolls of the chain.

Each connection element is equipped with two through holes, respectively first and second, and each idler roll is equipped with an axial hole into which the relative pin is inserted.

In the auxiliary chain according to the invention, on both sides thereof, two of the adjacent connection elements are suitable to be partly superimposed one on top of the other in such a manner that the first hole of each connection element is suitable to align with the second hole of the adjacent connection element and also with the axial hole of an idler roll.

In the three holes thus aligned, the respective join pin is then inserted and left free to rotate but constrained at its ends at least to the more outward of the two, superimposed connection elements.

In the preferential embodiment of the invention, the join pin is inserted with a gap inside the axial hole of the relative idler roll, so that the thrust forces and the stresses transmitted by the tracks to the idler rolls do not affect the relative pins.

According to a variant, an element of association and constraint, such as, for example, a bushing or similar, is inserted into the first and second aligned holes of two adjacent and partly superimposed connection elements. According to one characteristic of the invention, the thrust forces transmitted by the tracks to the idler rolls are discharged prevalently onto the connection elements in correspondence with the zones of frontal and/or lateral contact between the latter and the idler rolls themselves. These contact zones are studied to discharge the forces acting on the idler rolls in a uniform and well-distributed manner, and absorb most of the stresses so as to preserve the join pins and thus increase the working life of the auxiliary chain.

In the preferential embodiment of the invention, the contact zones coincide substantially with the annular portions provided in correspondence with the two ends of every idler roll.

BRIEF DESCRIPTION OF THE DRAWINGS

These and other characteristics of the invention will become clear from the following description of the preferred form of embodiment, given as a non-restrictive example, with reference to the attached drawings wherein.

DETAILED DESCRIPTION OF PREFERRED EMBODIMENT

Figure 1:
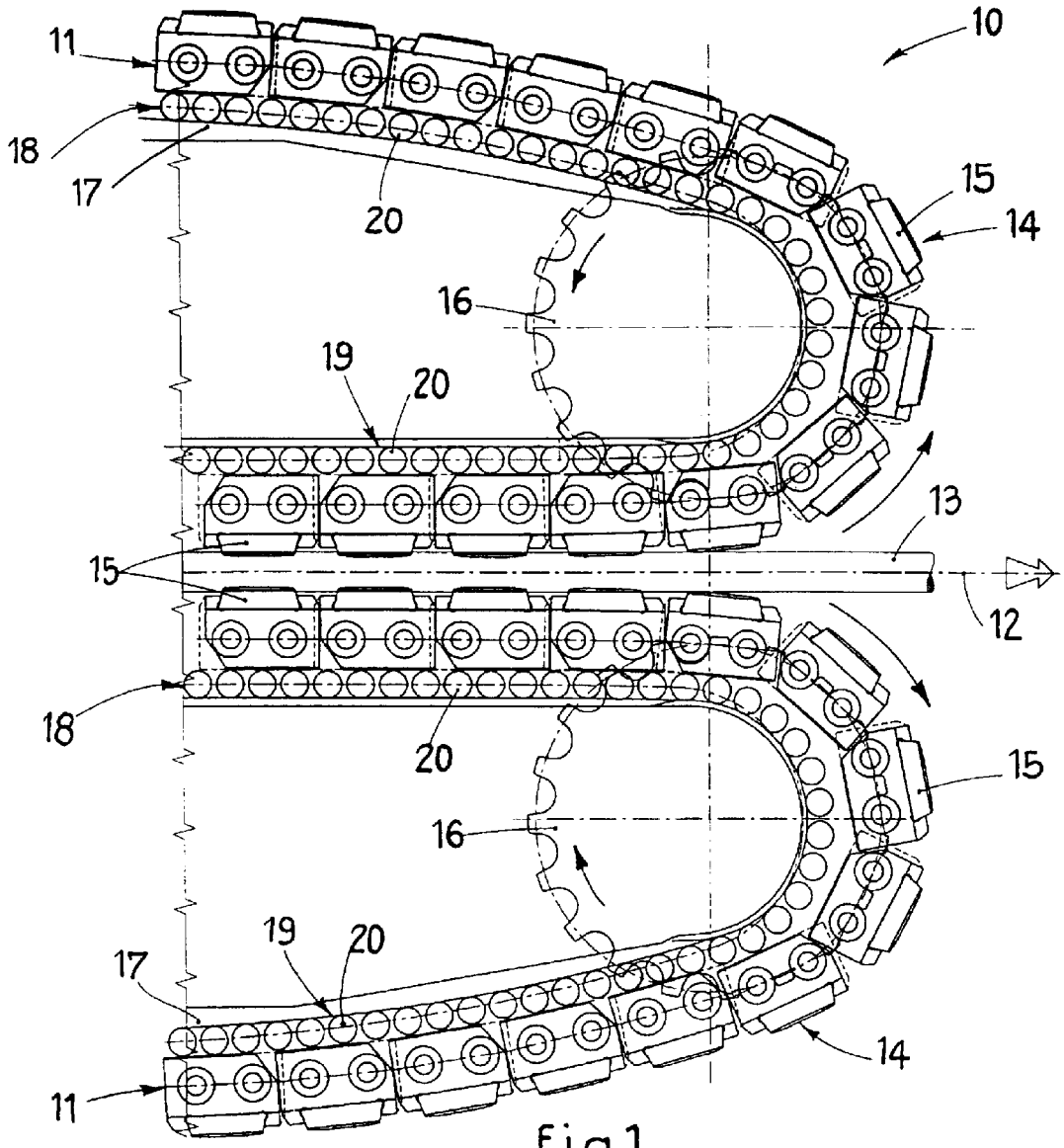
FIG. 1 is a part view of a drawing assembly in a drawing machine using two auxiliary chains according to the invention.

FIG. 1 is a part view of a drawing assembly 10 of a drawing machine comprising two tracks 11, counter-rotating and opposite each other, symmetrical to the axis of drawing 12 of a product 13, in this case a bar.

The assembly 10 is suitable to draw the product 13 through a die plate which is not shown in the drawings, located upstream of the drawing assembly 10.

Each track 11 consists of a plurality of links 14 hinged together in correspondence with the relative ends; on each of them a relative pad 15 is solidly mounted, suitable to grip the product 13 in correspondence with the rectilinear segment of the track 11 and draw it.

Each track 11 is made to rotate by a driver toothed wheel 16 and returned by a driven toothed wheel, not visible in the drawings, mounted respectively at the opposite ends of a rigid supporting plate 17.

Between the supporting plate 17 and the relative track 11 there is an auxiliary chain 18 according to the invention, on which the respective track 11 is suitable to rest at least in correspondence with its rectilinear segment.

The function of the auxiliary chain 18 is to reduce the friction between the track 11 and the relative supporting plate 17, and to discharge, in a uniform and distributed manner, the thrust forces of drawing and compression acting on the individual links 14 of the tracks 11 during the drawing steps; these thrust forces may even be quite high, depending on the enormous drawing loads needed to obtain the desired reductions in section of the product 13 through the die plate or draw plate.

As shown in FIGS. 2–5, the auxiliary chain 18 according to the invention consists of a plurality of links 19 each comprising a roll 20, two connection elements 21, a join pin 22 and two bushings 23.

The roll 20 is equipped with an axial hole 24 inside which the respective join pin 22 is inserted in such a manner that the ends 122 of the latter protrude by a defined segment, substantially coinciding with the height of the bushings 23, from the ends of the roll 20.

Figure 6:
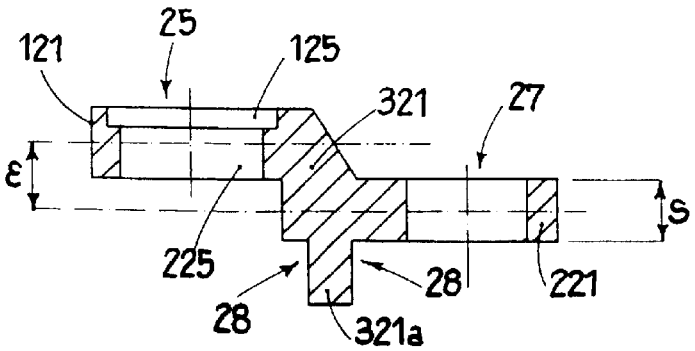
FIG. 6 shows an enlarged detail of FIG. 5.

As shown in FIG. 6, each connection element 21 has a longitudinal section defined by a first segment 121 and a second segment 221, substantially parallel, connected together by an intermediate inclined segment 321.

The segments 121 and 221 have the same thickness "s" and are vertically offset with respect to each other by a value "$\epsilon$" substantially equal to the thickness "s".

With this structure, the first segment 121 of a connection element 21 of a first link 19 is suitable to position itself above the second segment 221 of a connection element 21 of the adjacent link 19, the second segment 221 being contained in the space between the first segment 121 and a lateral face of the roll 20.

Figure 7:
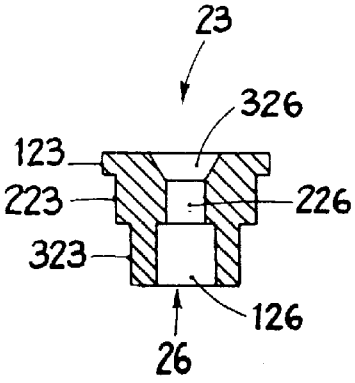
FIG. 7 shows another enlarged detail of FIG. 5.
Figure 2:
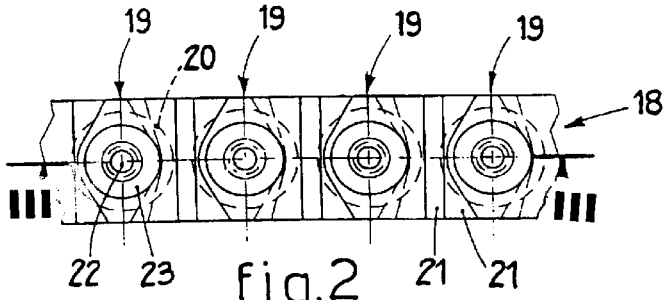
FIG. 2 is a side view of a segment of an auxiliary chain according to the invention.

As shown in FIG. 7, each bushing 23 is substantially shaped like a truncated cone, defined by three cylindrical coaxial parts, respectively 123, 223 and 323, with a progressively decreasing section.

The first segment 121 of each of the connection elements 21 is equipped with a hole 25 having a first segment 125 and a second segment 225 with a section suitable to house, substantially due to their having the same shape, respectively the cylindrical parts 123 and 223 of the bushing 23. The second segment 221 of the connection elements 21, on the contrary, is equipped with a hole 27 suitable to house the cylindrical part 323 of the same bushing 23.

Figure 5:
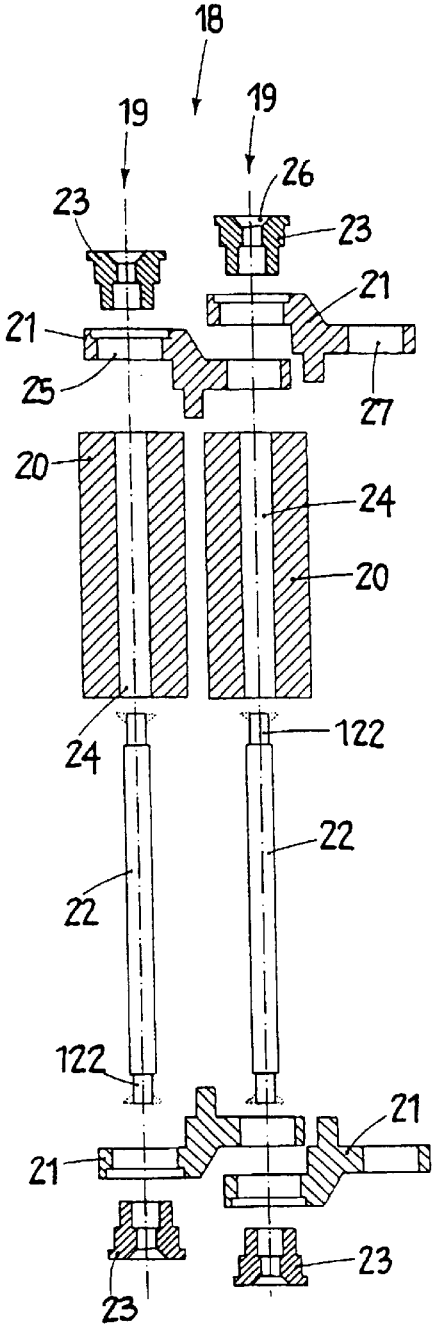
FIG. 5 is a part view of an exploded section of FIG. 3.

As shown in FIG. 5, the hole 25 of a first connection element 21 is suitable to align with the hole 27 of a second connection element 21 of the adjacent link 19, the holes 25 and 27 being aligned with the hole 24 of the roll 20 and with an axial hole 26 of the bushing 23.

Inside the axial hole 26, the end 122 of a respective pin 22 is suitable to be inserted and clamped; since two contiguous connection elements 21 are inserted into the holes 25 and 27, the pin 22 is thus shared between two adjacent links 19.

To be more exact, as shown in FIG. 7, the hole 26 has a first segment 126 with. a transverse section substantially equal to the transverse section of the pin 22, a second intermediate segment 226 with a transverse section equal to the narrowest section of the end 122 of the pin 22, and a third flared segment 326 inside which the end 122 is riveted.

The riveting of the ends 122 of the pin 22 (as shown with the line of dashes in FIG. 5), therefore, gives a stable connection between the various elements 20, 21 and 23 of a single link 19, and also between two adjacent links 19; in this way, we obtain with a single pin 22 the function which in the state of the art is performed by at least two pins.

Figure 3:
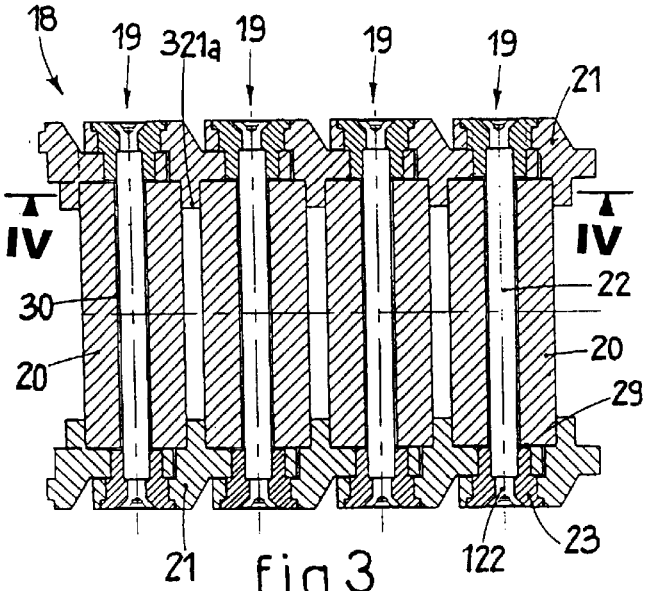
FIG. 3 shows a section from III to III of FIG. 2.
Figure 4:
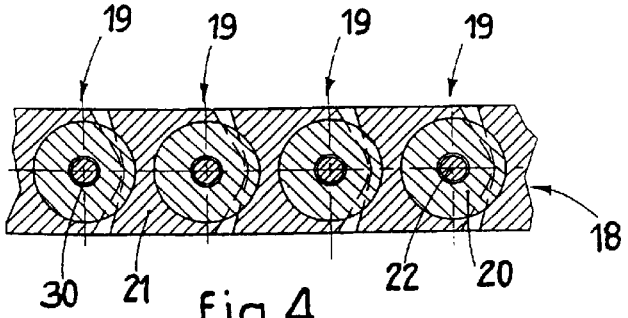
FIG. 4 shows a section from IV to IV of FIG. 3.

The intermediate segment 321 of each of the connection elements 21 comprises a protrusion 321*a*, arranged orthogonal to the plane on which the relative element 21 lies and suitable to be inserted into the space defined between two adjacent rolls 20 (FIG. 3).

The protrusion 321*a* is suitable to define, together with the rectilinear part of the element 21, zones of contact 28 cooperating with the corner zones of the opposite faces of the rolls 20 (FIG. 6).

The rolls 20 of the chain 18 according to the invention cooperate with the inner surface of the links 14 of the respective track 11 and rotate around their own axis, due to the drawing action imparted thereto by the links 14.

According to this characteristic mentioned above, the pins 22 constrain the various elements 20, 21 and 23 together, and also connect one link 19 to the adjacent link 19 by means of the connection elements 21.

Unlike what happens in conventional auxiliary chains, the pins 22 are not directly subjected to the considerable thrusts of drawing and compression acting on the rolls 20 and transmitted thereto by the tracks 11 which in turn receive them from the product 13 being drawn.

In fact, gaps 29 are defined between the connection elements 21 and the ends of the rolls 20, just as gaps 30 are defined between the axial hole 24 of each roll 20 and the relative pin 22 (FIG. 3).

In this way, the thrust forces acting on the rolls 20 are discharged mostly on the connection elements 21 only through the contact zones 28; this preserves the pins 22 from dangerous shearing forces. Moreover, since the contact zones 28 are made in a corner zone of the relative connection elements 21, maximum resistance and maximum absorption of the stresses transmitted by the tracks 11 are obtained.

Another advantage of the auxiliary chain 18 according to the invention is that every link 19 comprises a single roll 20 and is therefore suitable to follow in the best possible way the curved segments of the winding path around the relative rigid supporting plate 17.

In fact, every link 19 is suitable to oscillate with respect to the following link 19 since the clamping connection obtained by inserting a single pin 22 into the holes 25 and 27 of two connection elements 21 of two adjacent links 19 does not prevent their reciprocal rotation.

It is obvious that modifications and additions may be made to this invention, but these shall remain within the field and scope thereof.

For example, there may be no bushings 23 and the holes 25 and 27 may have a section suitable to house the ends 122 of the pin 22 directly. Or another attachment system may be used instead of riveting, such as for example of the type using screws or other removable attachment elements.

What is claimed is:

1. Auxiliary chain for a drawing assembly, the drawing assembly comprising at least a track formed by a plurality of contiguous links able to act on a product to draw it, said auxiliary chain being interposed between the a track and supporting means, the auxiliary chain comprising:

a plurality of contiguous links, each of said links comprising an idler roll equipped with an axial hole, a join pin, and two connection elements, each connection element equipped with at least two through holes, a first through hole of a first connection element being suitable to be a ligned with a second through hole of the adjacent connection element and with said axial hole to allow said join pin to be inserted and constrained in order to connect two adjacent links, the connection elements being suitable to cooperate with a respective end of said idler roll, the connection elements comprising a longitudinal section defined by a first segment equipped with the first through hole and by a second segment, substantially parallel to the first segment, equipped with the second through hole, said first and second segments being connected together by an inclined intermediate segment, the first segment of the connection element comprising a link suitable to be superimposed over the second segment of the connection element of the adjacent link to take the respective through holes into reciprocal alignment, wherein said intermediate segment comprises a protrusion, arranged orthogonal to the plane on which the connection element lies, suitable to be inserted into the space between the rolls of two adjacent links and to define contact zones located in a corner position, wherein every connection element is suitable to be arranged at least partly superimposed over the ends of at least the corresponding idler roll and an idler roll of a contiguous link.

2. Auxiliary chain as in claim 1, wherein there is a gap between said axial hole of every roll and the join pin of the same link.

3. Auxiliary chain as in claim 1, wherein said first and second segments have the same thickness (s) and are vertically offset with respect to each other by a value ($\epsilon$) substantially equal to said thickness (s).

4. Auxiliary chain as in claim 1, wherein it comprises a bushing suitable to be inserted into said aligned holes substantially of the same shape.

5. Auxiliary chain as in claim 1, wherein said join pins are suitable to be constrained to said connection elements by riveting at the two ends.

6. Auxiliary chain as in claim 1, wherein said connection elements are suitable to define a zone of contact with the idler roll of the same link.

7. Auxiliary chain as in claim 6, wherein said contact zone is arranged in correspondence with a corner zone of a surface of the idler roll.

8. A drawing assembly comprising at least a track formed by a plurality of contiguous links able to act on a product to draw it, a supporting means, and the auxiliary chain of claim 1 being interposed between a track and supporting means.

* * * * *